US009353766B2

(12) United States Patent
Petrucci

(10) Patent No.: US 9,353,766 B2
(45) Date of Patent: May 31, 2016

(54) CONTAINMENT STRUCTURE FOR AN ACTUATION UNIT FOR IMMERSION PUMPS, PARTICULARLY FOR COMPACT IMMERSION PUMPS TO BE IMMERSED IN WELLS

(75) Inventor: Paolo Petrucci, Montecchio Maggiore (IT)

(73) Assignee: PM S.r.l., Arzignano (IT)

( * ) Notice: Subject to any disclaimer, the term of this patent is extended or adjusted under 35 U.S.C. 154(b) by 652 days.

(21) Appl. No.: 12/926,850

(22) Filed: Dec. 14, 2010

(65) Prior Publication Data

US 2011/0142697 A1 Jun. 16, 2011

(30) Foreign Application Priority Data

Dec. 14, 2009 (IT) ..... PD2009A0372

(51) Int. Cl.

| | |
|---|---|
| ***F04D 29/62*** | (2006.01) |
| ***F04D 13/08*** | (2006.01) |
| ***F04B 17/03*** | (2006.01) |
| ***F04B 35/04*** | (2006.01) |
| ***F04B 47/06*** | (2006.01) |
| ***F04D 29/42*** | (2006.01) |
| ***F04D 13/06*** | (2006.01) |
| ***F04D 13/10*** | (2006.01) |

(52) U.S. Cl.

CPC ..... *F04D 29/628* (2013.01); *F04B 17/03* (2013.01); *F04B 35/04* (2013.01); *F04B 47/06* (2013.01); *F04D 13/0686* (2013.01); *F04D 13/086* (2013.01); *F04D 13/10* (2013.01); *F04D 29/426* (2013.01)

(58) Field of Classification Search

CPC ..... F04D 13/06; F04D 13/10; F04D 13/086; F04D 13/08; F04D 17/03; F04D 35/04; F04D 47/06; H01R 13/111

USPC ..... 417/422, 423.3, 423.15, 423.7; 166/62, 166/66.4, 105, 242.6; 174/47; 310/71, 87

See application file for complete search history.

(56) References Cited

U.S. PATENT DOCUMENTS

| | | | | | |
|---|---|---|---|---|---|
| 2,648,286 | A | * | 8/1953 | Bergh | 417/422 |
| 2,670,686 | A | * | 3/1954 | Bergh | 417/422 |
| 2,897,763 | A | * | 8/1959 | Wright | 417/360 |
| 3,248,582 | A | * | 4/1966 | Brown | 310/87 |
| 3,278,885 | A | * | 10/1966 | Klinger | 439/279 |
| 3,294,993 | A | * | 12/1966 | Komor et al. | 310/71 |
| 3,308,316 | A | * | 3/1967 | Pfahl | 310/87 |
| 3,457,867 | A | * | 7/1969 | Komor et al. | 417/422 |
| 3,604,964 | A | * | 9/1971 | Conrad et al. | 310/71 |
| 3,716,309 | A | * | 2/1973 | Mitchell | 417/422 |

(Continued)

*Primary Examiner* — Alexander Comley

(74) *Attorney, Agent, or Firm* — Modiano & Associati; Albert Josif; Daniel J. O'Byrne

(57) ABSTRACT

A containment structure for an actuation unit for compact immersion pumps for wells having a box-like casing, which is fitted over an electric actuation, motor for pumps, which it encloses hermetically, a cartridge, which accommodates a driving device of the motor and has a radial space occupation that is substantially smaller than, or equal to, the radial space occupation of the casting, and quick-coupling connectors provided at a head of the cartridge and at a bottom of the casing, adapted for the quick and reversible connection of the cartridge to the casing, the connectors comprising at least one power supply connector, adapted to electrically connect the driving device to an electric power supply, with which the casing is equipped, and at least one control connector, which is adapted for the functional connection of the driving device to the motor for driving it.

12 Claims, 5 Drawing Sheets

(56) References Cited

U.S. PATENT DOCUMENTS

| | | | | | |
|---|---|---|---|---|---|
| 3,761,750 | A * | 9/1973 | Green | 310/87 |
| 3,952,218 | A * | 4/1976 | Deters | 310/71 |
| 4,019,836 | A * | 4/1977 | Deters | 417/360 |
| 4,104,550 | A * | 8/1978 | Penhorwood | 310/71 |
| 4,297,627 | A * | 10/1981 | Schaefer | 318/778 |
| 4,339,231 | A * | 7/1982 | Conery et al. | 417/40 |
| 4,409,504 | A * | 10/1983 | Wilson et al. | 310/87 |
| 4,536,138 | A * | 8/1985 | Romand-Monnier et al. | 417/422 |
| 4,546,300 | A * | 10/1985 | Shaikh | 318/786 |
| 5,070,940 | A * | 12/1991 | Conner et al. | 166/65.1 |
| 5,113,101 | A * | 5/1992 | Liu et al. | 310/87 |
| 5,145,007 | A * | 9/1992 | Dinkins | 166/386 |
| 5,207,562 | A * | 5/1993 | Neibrook et al. | 417/234 |
| 5,297,943 | A * | 3/1994 | Martin | 417/422 |
| 5,801,465 | A * | 9/1998 | Yamada | 310/71 |
| 6,109,891 | A | 8/2000 | Sato | |
| 6,135,732 | A * | 10/2000 | Angorin | 417/423.3 |
| 6,142,237 | A * | 11/2000 | Christmas et al. | 166/376 |
| 6,179,585 | B1 * | 1/2001 | Kobylinski et al. | 417/423.3 |
| 6,213,202 | B1 * | 4/2001 | Read, Jr. | 166/55.1 |
| 6,332,499 | B1 * | 12/2001 | Kobylinski et al. | 166/65.1 |
| 6,375,497 | B1 * | 4/2002 | DiFlora | 439/566 |
| 6,398,521 | B1 * | 6/2002 | Yorulmazoglu | 417/360 |
| 6,422,839 | B1 | 7/2002 | Brockner | |
| 6,601,651 | B2 * | 8/2003 | Grant | 166/370 |
| 6,700,252 | B2 * | 3/2004 | Fleshman et al. | 310/87 |
| 6,712,146 | B2 * | 3/2004 | Estep et al. | 166/377 |
| 6,780,037 | B1 * | 8/2004 | Parmeter et al. | 439/191 |
| 6,837,744 | B2 * | 1/2005 | To et al. | 439/587 |
| 7,208,855 | B1 * | 4/2007 | Floyd | 310/71 |
| 7,325,596 | B2 * | 2/2008 | Ebner | 166/65.1 |
| 7,443,067 | B2 * | 10/2008 | Schlosser | 310/71 |
| 7,481,674 | B2 * | 1/2009 | Murakami et al. | 439/587 |
| 7,595,573 | B2 * | 9/2009 | Watson et al. | 310/87 |
| 7,632,124 | B2 * | 12/2009 | Kennedy et al. | 439/274 |
| 2002/0163263 | A1 * | 11/2002 | Uffelman | 310/71 |
| 2007/0056724 | A1 * | 3/2007 | Spring et al. | 166/66.4 |
| 2007/0071612 | A1 * | 3/2007 | Yuratich | 417/53 |
| 2007/0236097 | A1 | 10/2007 | Hazama | |
| 2008/0286134 | A1 * | 11/2008 | Regalado et al. | 417/423.3 |
| 2008/0293280 | A1 * | 11/2008 | Kennedy et al. | 439/274 |
| 2009/0068037 | A1 * | 3/2009 | Shaw et al. | 417/423.3 |

* cited by examiner

CONTAINMENT STRUCTURE FOR AN ACTUATION UNIT FOR IMMERSION PUMPS, PARTICULARLY FOR COMPACT IMMERSION PUMPS TO BE IMMERSED IN WELLS

The present invention relates to a containment structure for an actuation unit for immersion pumps, particularly for compact immersion pumps for wells.

BACKGROUND OF THE INVENTION

Actuation units for immersion pumps currently comprise an electric motor which is associated in a lower region with the pump and is closed in a hermetic casing which is integrally connected to the pump casing.

The motor actuation device can provide either for the simple direct supply of power to the motor or for a motor driving device, depending on the pump model chosen to meet the operating requirements.

To prevent the motor from being damaged by turning over with no load if the pump is not primed, in some cases there are sensors for detecting the level of the water in the well where the pump is located.

These sensors are adapted to detect the presence or absence of water at the level where they are arranged in the well.

Therefore, if the level of the water in the well does not reach the sensor, this is reported by the sensor and the motor is stopped, if it is running, or is prevented from starting if it is not running.

One drawback of this type of solution consists in the fact that the sensors can lose efficiency over time, by becoming gradually dirty during their active life and thus leading to incorrect reports which can cause damage to the motor if they do not report the absence of a water level in the well that is sufficient for pumping, or can prevent the operation of the pump if they do not detect the presence of water that is actually in contact with them.

The need is felt, therefore, to have devices which are reliable in detecting a condition of absence of sufficient pump priming and are at the same time efficient and durable.

Moreover, in order to make the performance of the pump suitable for the possible various different requirements that it is designed to meet, in order to save on actuation energy, it is currently known to provide an electronic device for driving the motor, particularly of the type known as an inverter.

This device is generally integrated in the pump actuation device, which is therefore external to the well and generally in proximity to the region of use of the water to be pumped.

One problem that is strongly felt in the field of making actuation units that are provided with motor control inverters consists in that the resistances and inductances of the cables for connecting the inverter to the motor impose a technical limitation on their length, which must be limited in order to ensure effective and efficient transmission of the driving signal.

Therefore, in practice an inverter that is arranged remotely from the motor cannot drive that motor effectively if the well is too deep or if the pump actuation device, which comprises the inverter, must be provided at a considerable distance from the motor.

In order to overcome this drawback, actuation units are currently known in which the motor is integrated with an inverter-based driving device.

However, the use of these devices presents some drawbacks, including the fact that they are structurally complex and expensive.

Moreover, they are not easy to maintain, and indeed if the motor or its driving device fails, it is necessary to replace the entire unit since they are integrated.

SUMMARY OF THE INVENTION

The aim of the present invention is to provide a containment structure for an actuation unit that makes it possible to meet the described requirement, thus overcoming the drawbacks of the currently known devices, in particular by allowing the actuation unit to make the performance of the pump proportional to the needs that it is intended to serve, while at the same time allowing an easy and low-cost maintenance thereof.

Within this aim, an object of the invention is to propose a containment structure that allows easy replacement of the motor driving device in the event of failure.

Another object of the invention is to provide a containment structure that makes it possible to easily substitute the motor driving device in order to meet different requirements or operating conditions of the pump.

Another object of the invention is to provide a containment structure that is simple and easy to use and can be manufactured at low cost.

This aim, as well as these and other objects which will become better apparent hereinafter, are achieved by a containment structure for an actuation unit for immersion pumps, particularly for compact immersion pumps for wells, and the like, characterized in that it comprises

- a box-like casing, which is fitted over an electric actuation motor for pumps, which it encloses hermetically,
- a cartridge, which hermetically accommodates a driving device of said motor and has a radial space occupation that is substantially smaller than, or equal to, the radial space occupation of said casing,
- quick-coupling connectors provided at a head of said cartridge and at a bottom of said casing, which are adapted for the quick and reversible connection of said cartridge to said casing, said connectors comprising
- at least one power supply connector, which is adapted to electrically connect said driving device to electric power supply means, with which said casing is equipped,
- at least one control connector, which is adapted for the functional connection of said driving device to said motor for driving it.

BRIEF DESCRIPTION OF THE DRAWINGS

Further characteristics and advantages of the invention will become better apparent from the description of a preferred but not exclusive embodiment of the actuation unit according to the invention, illustrated by way of non-limiting example in the accompanying drawings, wherein.

DESCRIPTION OF THE PREFERRED EMBODIMENTS

Figure 1:
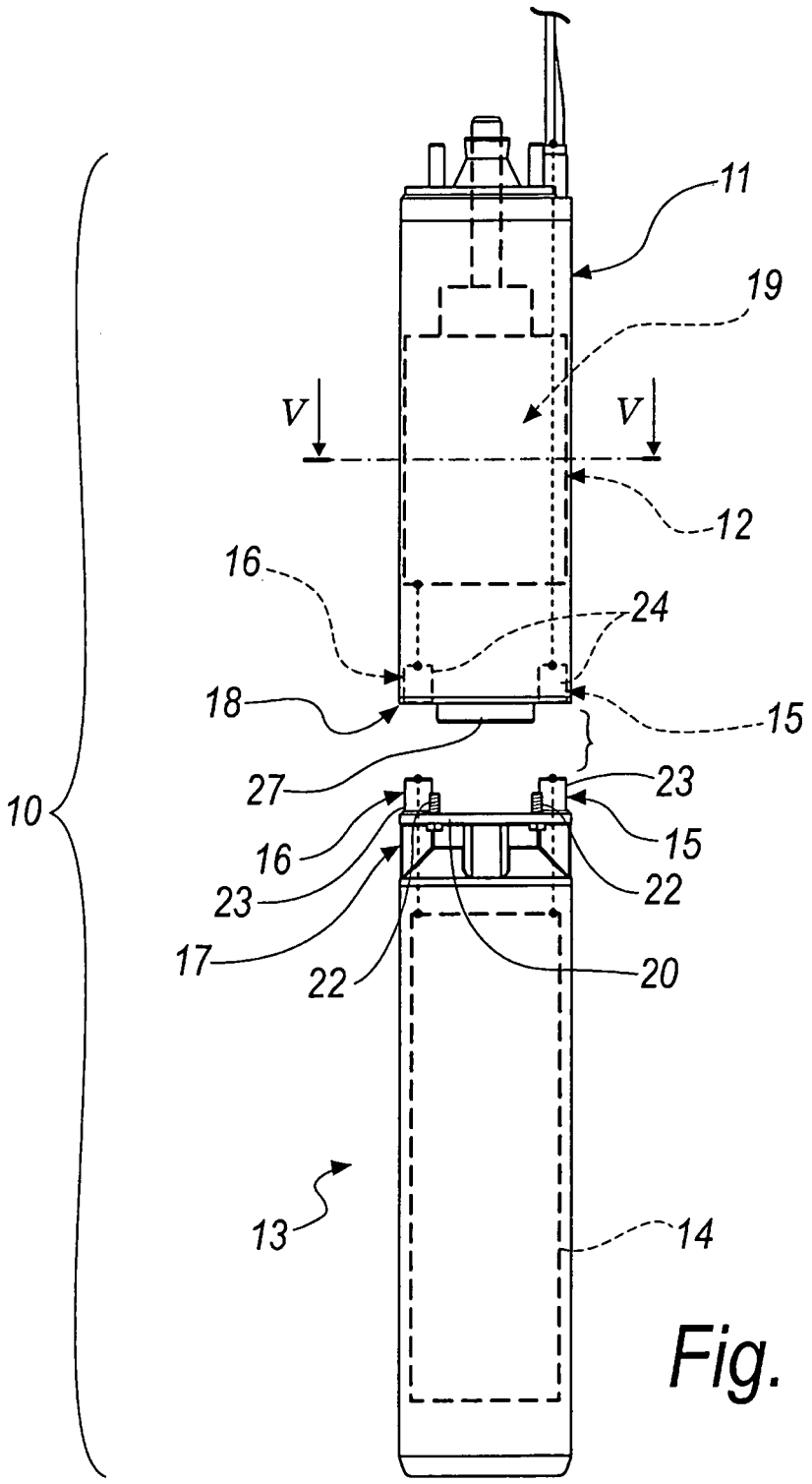
FIG. 1 is a side elevation view of an actuation unit according to the invention.
Figure 2:
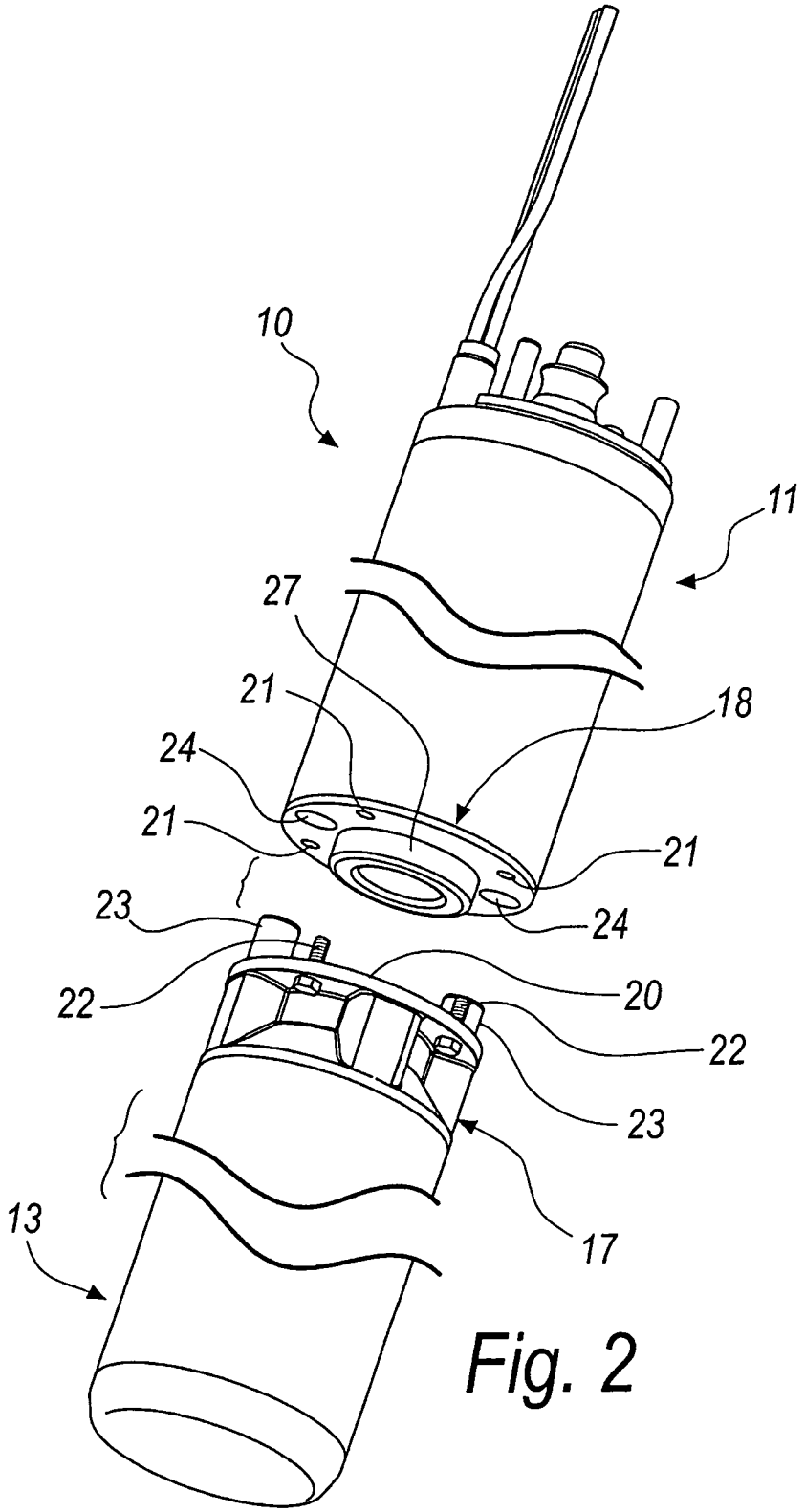
FIG. 2 is a perspective view of an actuation unit according to the invention.
Figure 3:
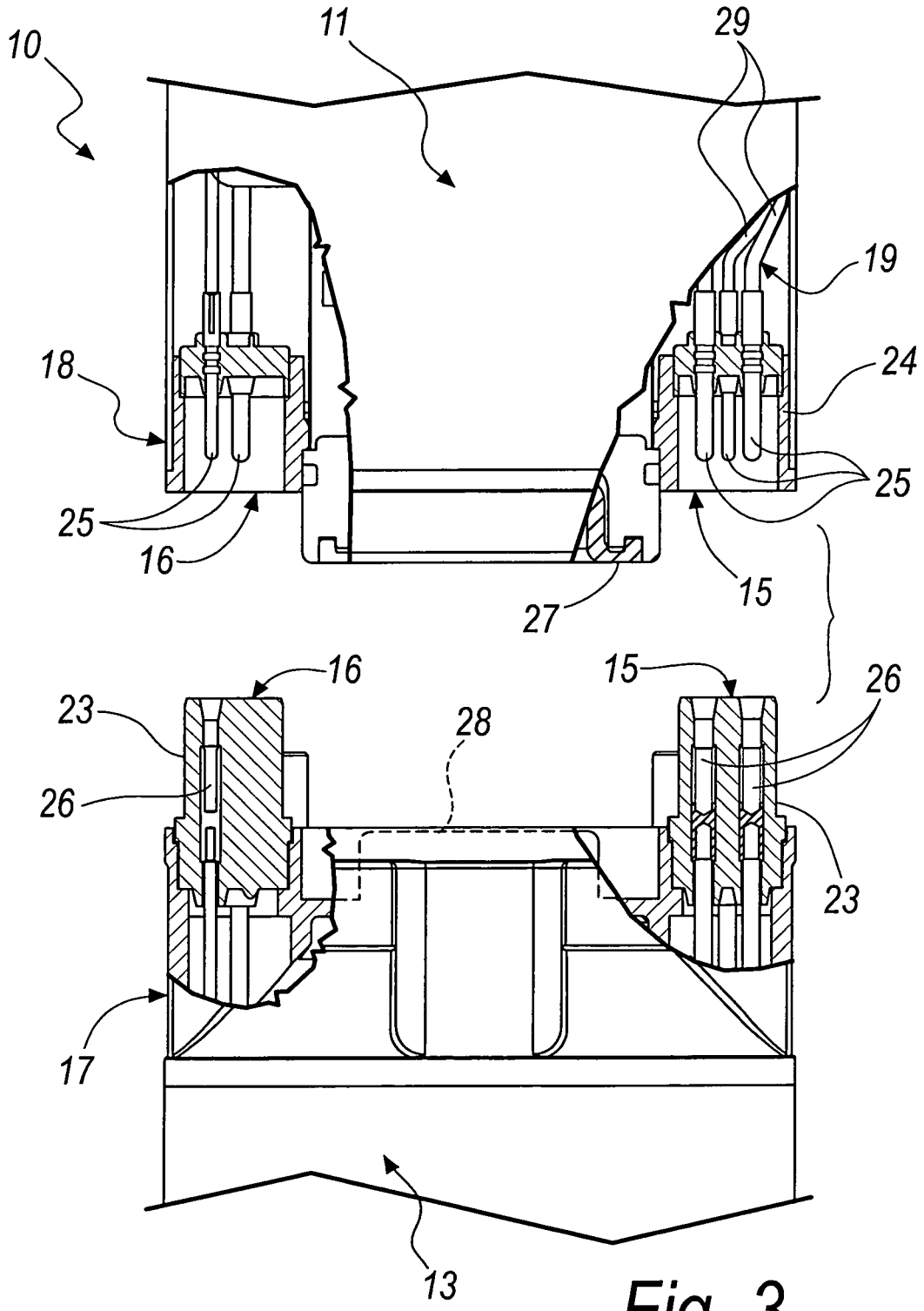
FIG. 3 is a partially sectional enlarged-scale view of a detail of an actuation unit according to the invention.
Figure 4:
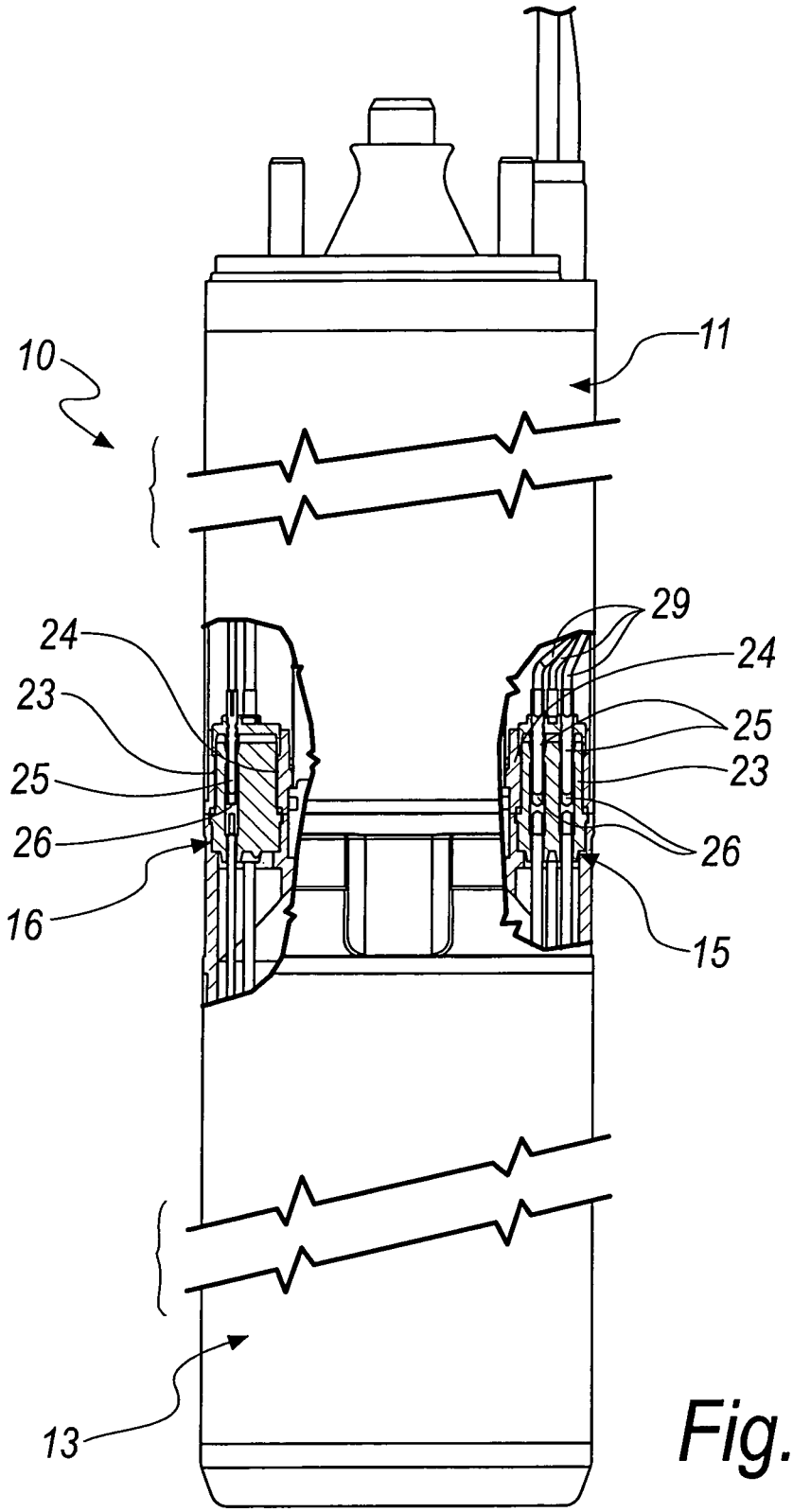
FIG. 4 is a partially sectional view of an actuation unit according to the invention, in a configuration for use.
Figure 5:
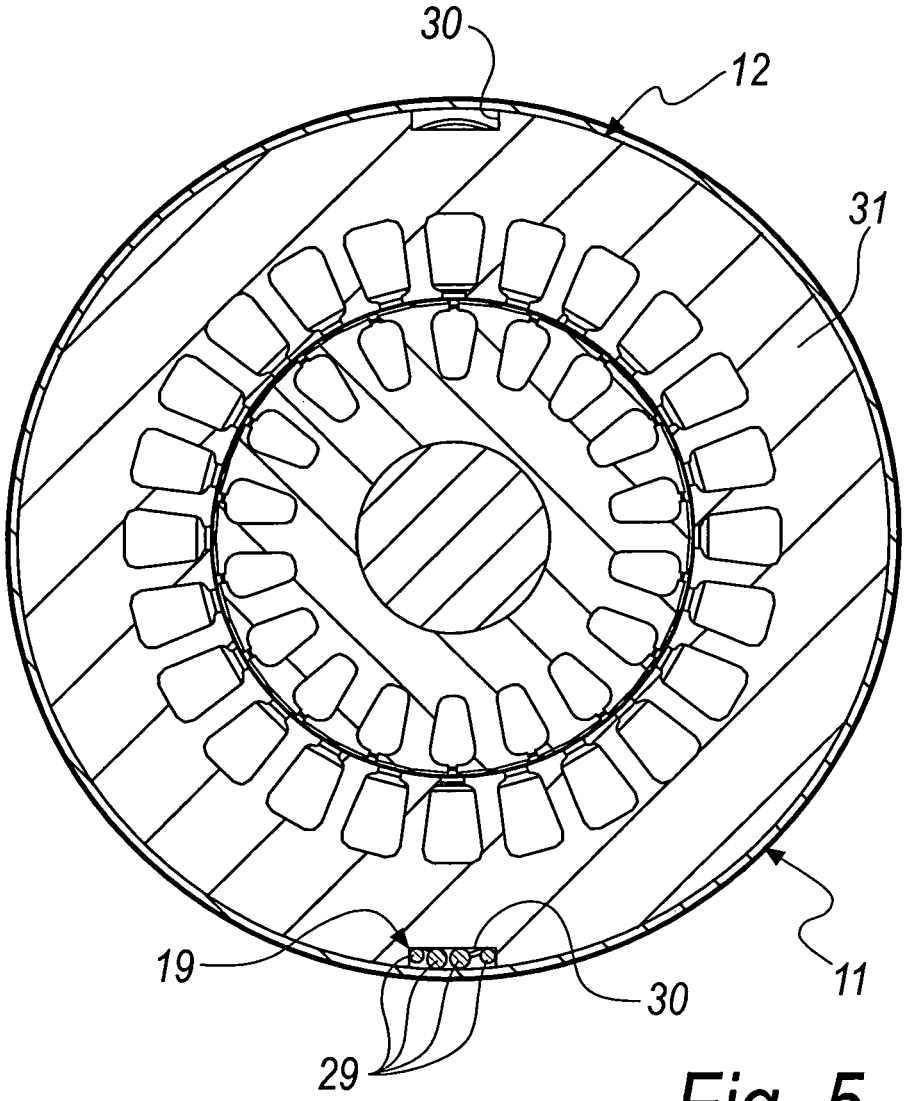
FIG. 5 is a sectional view of an actuation unit according to the invention, taken along the line V-V of FIG. 1.

It should be noted that anything found to be already known during the patenting process is understood not to be claimed and to be the subject of a disclaimer.

With reference to the figures, the reference numeral 10 generally designates a containment structure for an actuation unit for immersion pumps, particularly for compact immersion pumps for wells, and the like, which has a distinctive particularity in that it comprises

- a box-like casing 11, which is fitted over an electric actuation motor 12 for pumps, which it encloses hermetically,
- a cartridge 13, which hermetically accommodates a motor driving device 14 which advantageously comprises an inverter for controlling the motor 12,
- quick-coupling connectors 15 and 16, provided at a head 17 of the cartridge 13 and at a bottom 18 of the casing 11, which are adapted for the quick and reversible connection of the cartridge 13 to the casing 11.

The connectors 15 and 16 comprise

- a power supply connector 15, which is adapted to electrically connect the driving device 14 to electric power supply means 19, with which the casing 11 is equipped, and
- a control connector 16, which is adapted for the functional connection of the driving device 14 to the motor 12 for driving it.

In alternative embodiments of the invention it is possible to provide, in a substantially equivalent manner, more than one power supply connector and more than one control connector.

Conveniently, the head 17 and the bottom 18 are equipped for mutual connection by virtue of threaded connection means, which preferably comprise

- a perforated flange 20 provided on the head 17,
- threaded seats 21 provided on the bottom 18 at the holes of the flange 20,
- screws 22 for locking the flange 20 to the bottom 18, which are adapted to engage with the threaded seats 21 thereof.

The connectors 15 and 16 advantageously comprise

- a pin 23,
- a female seat 24, which is adapted to receive the pin 23 with a waterproof coupling,
- male electrical contacts 25 of a circuit for supplying power to the driving device 14 and of a circuit for supplying power to the electric motor 12, which protrude within the female seat 24,
- female electrical contacts 26 of the power supply circuit, which are provided internally to the pin 23 in positions that correspond to the male contacts in order to receive them in electrical coupling.

More particularly, the pin 23 is conveniently made of elastically yielding polymeric material, preferably an elastomer.

Moreover, conveniently, the head 17 and the bottom 18 are equipped with means for mutual centering and alignment, which advantageously comprise a collar 27 and a protrusion 28 which is adapted to enter it during use, in a first preferred but not exclusive constructive configuration the collar 27 protruding from the bottom 18 and the protrusion 28 protruding from the head 17.

In a second configuration, which is alternative and substantially equivalent to the first configuration, the collar conveniently protrudes from the head 17 and the protrusion protrudes from the bottom 18.

Furthermore, the electric power supply means 19 conveniently comprise cables 29 for the supply of electric power, which connect the power supply connector 15 to an electric power source, not shown in the accompanying figures, a path for the passage of the cables 29 inside the casing 11 being provided which in particular conveniently comprises two slots 30 which are provided on the stator 31 of the motor 12 in positions which are diametrical and radially facing the inside of the casing 11.

The use of a containment structure 10 according to the invention is as follows.

In order to prepare the actuation unit for use, the operator connects the cartridge 13 to the casing 11, so as to insert the protrusion 28 in the collar 27 and the pins 23 in the female seats 24, so as to couple the connectors 15 and 16.

In this way, the male electric connectors 25 are inserted in the female electric contacts 26, closing the power supply circuits of the driving device 14 and of the motor 12.

The casing 11 and the cartridge 14 are integrally connected by tightening the screws in the threaded seats 21, thus locking the flange 20 to the bottom 18 that is provided with them.

Vice versa, in order to separate the cartridge 14 from the casing 11, the operator divides them, after unscrewing the screws 22, by extracting the pins 23 from the female seats 24.

Thus, a cartridge 14 can be easily interchanged with another cartridge in the event of malfunction or failure of the driving device 14 or if the operating requirements of the pump require a different driving device.

During operation, the driving device 14 is powered by means of the cables 29 and is connected thereto by means of the power supply connector 15.

Furthermore, by virtue of the latter, the driving device 14 receives the power supply of the motor 12, which it processes according to the performance that is required of the pump, supplying it by virtue of the control connector 16.

Thus, for example, if the pump begins to stop drawing owing to an insufficient level of water in the well in which it is located, the motor tends to turn over with no load.

When the driving device detects this operation, the power supply of the motor is interrupted in order to avoid damaging it.

Then, depending on the programming of the driving device, this device subsequently starts the motor at preset time intervals, monitoring its operation in order to detect whether it is turning with no load, in which case it again interrupts its power supply, or whether operation that corresponds to actual pumping has resumed.

In practice it has been found that the invention achieves the intended aim and objects, by providing a containment structure that makes it possible to use an actuation unit that is adapted to make the performance of the pump proportional to the needs that it is intended to serve, by virtue of the inverter, while at the same time allowing an easy and low-cost maintenance thereof, since it is possible to easily replace the cartridge that contains the driving device.

Furthermore, a containment structure according to the invention allows easy substitution of the motor driving device in the event of failure, by virtue of the quick-coupling connectors.

A containment structure according to the invention makes it possible to easily substitute the motor driving device in order to meet different requirements or operating conditions of the pump, furthermore allowing easier logistic management of the actuation units according to the invention.

It is in fact possible to provide cartridges with driving devices with different kinds of performance, which can be associated interchangeably with the casings in order to drive their motors so as to meet the various different operating requirements of the pumps that they are adapted to actuate.

By virtue of the passage of the cables inside the casing, a containment structure according to the invention makes it possible to meet the need to reduce radial space occupations, which is strongly felt in the field of immersion pumps.

Furthermore, a containment structure according to the invention is simple and easy to use and can be manufactured at low cost.

The invention thus conceived is susceptible of numerous modifications and variations, all of which are within the scope of the appended claims; all the details may furthermore be replaced with other, technically equivalent elements.

In practice, the materials used, so long as they are compatible with the specific use, as well as the contingent shapes and dimensions, may be any according to requirements and the state of the art.

The disclosures in Italian Patent Application No. PD2009A000372 from which this application claims priority are incorporated herein by reference.

What is claimed is:

1. A containment structure for actuation units of compact immersion pumps for wells, comprising a box-like casing, which is fitted over and hermetically encloses an electric actuation motor for pumps, a cartridge, which hermetically accommodates an inverter of said motor and has a radial space occupation that is substantially smaller than, or equal to, a radial space occupation of said casing, quick-coupling connectors provided at a head of said cartridge and at a bottom of said casing, which provide a quick and reversible connection of said cartridge to said casing, said connectors comprising at least one power supply connector, which electrically connects said inverter directly to electric power supply means, with which said casing is equipped, at least one control connector, which functionally connects said inverter to said motor for driving said motor by supplying electrical power to said motor through said control connector from said inverter and for controlling the electrical power supplied to said motor by said inverter; said at least one power supply connector and said at least one control connector being arranged in a facing relationship, at an upper end of said cartridge, respectively with said electric power supply means of said casing and with said motor; wherein said power supply connector comprises a first pin, a first female seat, which receives said first pin with a waterproof coupling, first male electrical contacts of a circuit for supplying power directly to said inverter which protrude within said first female seat, first female electrical contacts of said circuit for supplying power directly to said inverter, which are provided internally to said first pin in positions that correspond to said first male contacts to receive said first mail contacts in electrical coupling; and wherein said control connector comprises a second pin, a second female seat, which receives said second pin with a waterproof coupling, second male electrical contacts of a circuit for supplying power to said electric motor from said inverter which protrude within said second female seat, second female electrical contacts of said circuit for supplying power to said electric motor from said inverter, which are provided internally to said second pin in positions that correspond to said second male contacts to receive said second male contacts in electrical coupling.

2. The containment structure according to claim 1, wherein said head and said bottom are equipped for mutual connection by virtue of threaded connection means.

3. The containment structure according to claim 2, wherein said threaded connection means comprise a perforated flange provided on said head, threaded seats provided on said bottom, at holes of said flange, screws for locking said flange to said bottom, which are adapted to engage with said threaded seats thereof.

4. The containment structure according to claim 1, wherein said first and second pins are made of elastically yielding polymeric material.

5. The containment structure according to claim 4, wherein said polymeric material is an elastomer.

6. The containment structure according to claim 1, wherein said head and said bottom are equipped with means for mutual centering and alignment.

7. The containment structure according to claim 6, wherein said alignment and centering means comprise a collar and a protrusion which is adapted to enter the collar during use, said collar and said protrusion being provided in a configuration chosen between a first configuration, in which said collar protrudes from said bottom and said protrusion protrudes from said head, and a second configuration, in which said collar protrudes from said head and said protrusion protrudes from said bottom.

8. A containment structure for actuation units of compact immersion pumps for wells, comprising a box-like casing, which is fitted over and hermetically encloses an electric actuation motor for pumps, a cartridge, which hermetically accommodates an inverter of said motor and has a radial space occupation that is substantially smaller than, or equal to, a radial space occupation of said casing, quick-coupling connectors provided at a head of said cartridge and at a bottom of said casing, which provide a quick and reversible connection of said cartridge to said casing, said connectors comprising at least one power supply connector, which electrically connects said inverter directly to electric power supply means without electrical connection with said electric actuation motor, with which said casing is equipped, at least one control connector, which functionally connects said inverter to said motor for driving said motor by supplying electrical power to said motor through said control connector from said Inverter and for controlling the electrical power supplied to said motor by said inverter; said at least one power supply connector and said at least one control connector being arranged in a facing relationship, at an upper end of said cartridge, respectively with said electric power supply means of said casing and with said motor; wherein said power supply counselor comprises a first pin, a first female seat, which receives said first pin with a waterproof coupling, first male electrical contacts of a circuit for supplying power directly to said inverter which protrude within said first female seat, first female electrical contacts of said circuit for supplying power directly to said inverter, which are provided internally to said first pin in positions that correspond to said first male contacts to receive said first mail contacts in electrical coupling; and wherein said control connector comprises a second pin, a second female seat, which receives said second pin with a waterproof coupling, second male electrical contacts of a circuit for supplying power to said electric motor from said inverter which protrude within said second female seat, second female electrical contacts of said circuit for supplying power to said electric motor from said inverter, which are provided internally to said second pin in positions that correspond to said second male contacts to receive said second male contacts in electrical coupling, wherein said electric power supply means comprise cables for the supply of electric power, which connect said at least one power supply connector to an electric power source, at least one path for the passage of said cables inside said casing being provided, and wherein said at least one passage path comprises at least two slots which are provided on a stator of said motor in positions which axe diametrical and radially facing the inside of said casing.

9. The containment structure according to claim 1, wherein said motor is electrically connected in series to said inverter through said control connector.

10. The containment structure according to claim 1, wherein electrical power is supplied to said inverter through said power supply connector and electrical power is supplied to said motor from said inverter through said control connector.

11. The containment structure according to claim 8, wherein said motor is electrically connected in series to said inverter through said control connector.

12. The containment structure according to claim 8, wherein electrical power is supplied to said inverter through said power supply connector and electrical power is supplied to said motor Rom said inverter through said control connector.

* * * * *